US005632401A

United States Patent [19]

Hurd

[11] Patent Number: 5,632,401

[45] Date of Patent: May 27, 1997

[54] GARBAGE CONTAINER AND LINER DISPENSING SYSTEM

[76] Inventor: John W. Hurd, 8744 N. Farm Rd. #33, Ash Grove, Mo. 65604

[21] Appl. No.: 645,296

[22] Filed: May 13, 1996

[51] Int. Cl.[6] ..... B65F 1/06

[52] U.S. Cl. ..... 220/407; 220/501; 220/524; 220/531; 220/908

[58] Field of Search ..... 220/407, 404, 220/501, 503, 505, 523, 524, 527, 529, 531, 908, 334

[56] References Cited

U.S. PATENT DOCUMENTS

| | | | |
|---|---|---|---|
| 1,908,279 | 5/1933 | Baylis | 220/501 |
| 4,234,096 | 11/1980 | Hergaux | 220/908 |
| 4,319,694 | 3/1982 | Nehrbass et al. | 220/407 |
| 4,969,554 | 11/1990 | Sawaya | 220/908 |
| 5,183,157 | 2/1993 | Darden | 220/407 |
| 5,322,180 | 6/1994 | Ker | 220/407 |
| 5,447,762 | 9/1995 | Loren | 220/908 |

FOREIGN PATENT DOCUMENTS

| | | | |
|---|---|---|---|
| 4321750 | 1/1994 | Germany | 220/407 |

*Primary Examiner*—Stephen J. Castellano

[57] ABSTRACT

A garbage container and liner dispensing system including a cylindrical container having a recess formed in a lower end thereof. An internal bag storage compartment is formed within the recess in the lower end of the cylindrical container by a pair of spring-hinged lids secured to an upper end of the recess. A bag holding flange is positioned on a peripheral rim of the cylindrical container. A lid is dimensioned for removable positioning on the bag holding flange.

7 Claims, 3 Drawing Sheets

GARBAGE CONTAINER AND LINER DISPENSING SYSTEM

BACKGROUND OF THE INVENTION

1. Field of the Invention

The present invention relates to a garbage container and liner dispensing system and more particularly pertains to dispensing a continuing supply of garbage liners within a container with a garbage container and liner dispensing system.

2. Description of the Prior Art

The use of litter bins is known in the prior art. More specifically, litter bins heretofore devised and utilized for the purpose of receiving liter are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,372,272 to Jennings discloses a bad dispensing waste receptacle.

U.S. Pat. No. 5,031,793 to Chen et al. discloses a litter bin.

U.S. Pat. No. Des. 324,749 to Bray discloses the ornamental design for a litter bin.

U.S. Pat. No. 5,405,041 to Van Brackle discloses a self dispensing trash liner pail.

U.S. Pat. No. 4,721,226 to Yurko discloses a waste container-bag dispenser combination.

U.S. Pat. No. 4,850,507 to Lemongelli et al. discloses a trash container with disposable bags.

While these devices fulfill their respective, particular objective and requirements, the aforementioned patents do not describe a garbage container and liner dispensing system for dispensing a continuing supply of garbage liners within a container.

In this respect, the garbage container and liner dispensing system according to the present invention substantially departs from the conventional concepts and designs of the prior art, and in doing so provides an apparatus primarily developed for the purpose of dispensing a continuing supply of garbage liners within a container.

Therefore, it can be appreciated that there exists a continuing need for new and improved garbage container and liner dispensing system which can be used for dispensing a continuing supply of garbage liners within a container. In this regard, the present invention substantially fulfills this need.

SUMMARY OF THE INVENTION

In the view of the foregoing disadvantages inherent in the known types of litter bins now present in the prior art, the present invention provides an improved garbage container and liner dispensing system. As such, the general purpose of the present invention, which will be described subsequently in greater detail, is to provide a new and improved garbage container and liner dispensing system and method which has all the advantages of the prior art and none of the disadvantages.

To attain this, the present invention essentially comprises a cylindrical container having an open upper end, a closed lower end and a cylindrical side wall therebetween. The cylindrical side wall has a lower peripheral edge extending below the closed lower end. The closed lower end has a recess formed therein. A bottom wall of the recess has a drainage aperture therethrough. The cylindrical side wall has a drainage aperture therethrough upwardly of the closed lower end. The open upper end has a peripheral rim extending horizontally therefrom. The peripheral rim has a downturned outer portion. An internal bag storage compartment is formed within the recess in the closed lower end of the cylindrical container by a pair of spring-hinged lids secured to an upper end of the recess. A plurality of separable trash liners are secured within a dispensing box. The dispensing box is dimensioned for positioning within the internal bag storage compartment. A singular liner is extendable outwardly of the storage compartment and overlapping the peripheral rim of the cylindrical container. The system includes a bag holding flange comprised of an annular ring having an interior downturned annular portion and an exterior downturned annular portion. The interior downturned annular portion has an inwardly extending annular portion integral with a lower end thereof. The annular ring is positioned on the peripheral rim of the cylindrical container thereby covering the overlapping liner. The system further includes a lid having an annular configuration. The lid has a formed handle on an upper portion thereof. The lid has a lower annular portion dimensioned for removable positioning on the inwardly extending annular portion of the bag holding flange.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garbage container and liner dispensing system which has all the advantages of the prior art litter bins and none of the disadvantages.

It is another object of the present invention to provide a new and improved garbage container and liner dispensing system which may be easily and efficiently manufactured and marketed.

It is a further object of the present invention to provide a new and improved garbage container and liner dispensing system which is of durable and reliable construction.

An even further object of the present invention is to provide a new and improved garbage container and liner dispensing system which is susceptible of a low cost of manufacture with regard to both materials and labor, and which accordingly is then susceptible of low prices of sale to the consuming public, thereby making such a garbage container and liner dispensing system economically available to the buying public.

Still yet another object of the present invention is to provide a new and improved garbage container and liner dispensing system which provides in the apparatuses and methods of the prior art some of the advantages thereof, while simultaneously overcoming some of the disadvantages normally associated therewith.

Even still another object of the present invention is to provide a new and improved garbage container and liner dispensing system for dispensing a continuing supply of garbage liners within a container.

Lastly, it is an object of the present invention to provide a new and improved garbage container and liner dispensing system including a cylindrical container having a recess formed in a lower end thereof. An internal bag storage compartment is formed within the recess in the lower end of the cylindrical container by a pair of spring-hinged lids secured to an upper end of the recess. A bag holding flange is positioned on a peripheral rim of the cylindrical container. A lid is dimensioned for removable positioning on the bag holding flange.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
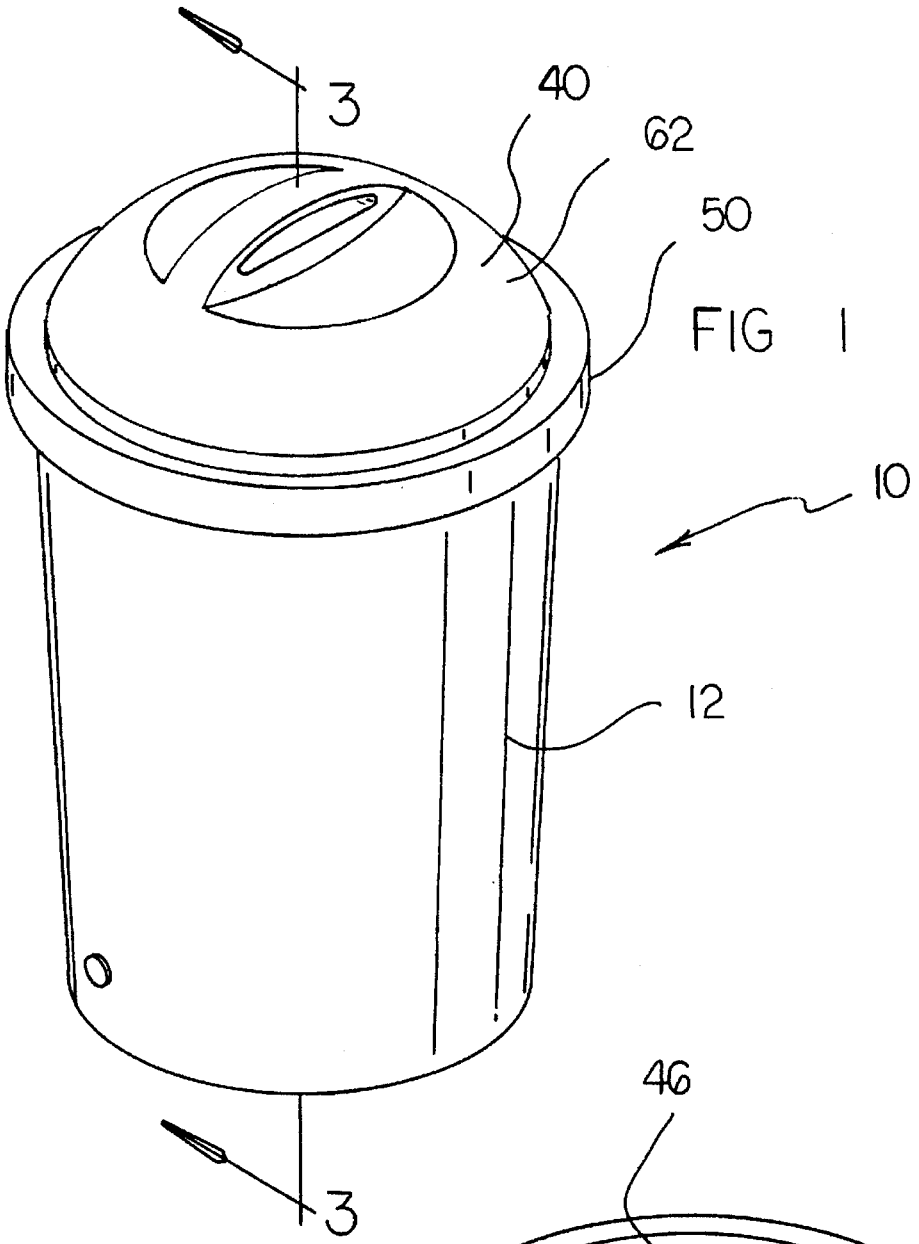
FIG. 1 is a perspective view of the preferred embodiment of the garbage container and liner dispensing system constructed in accordance with the principles of the present invention.
Figure 2:
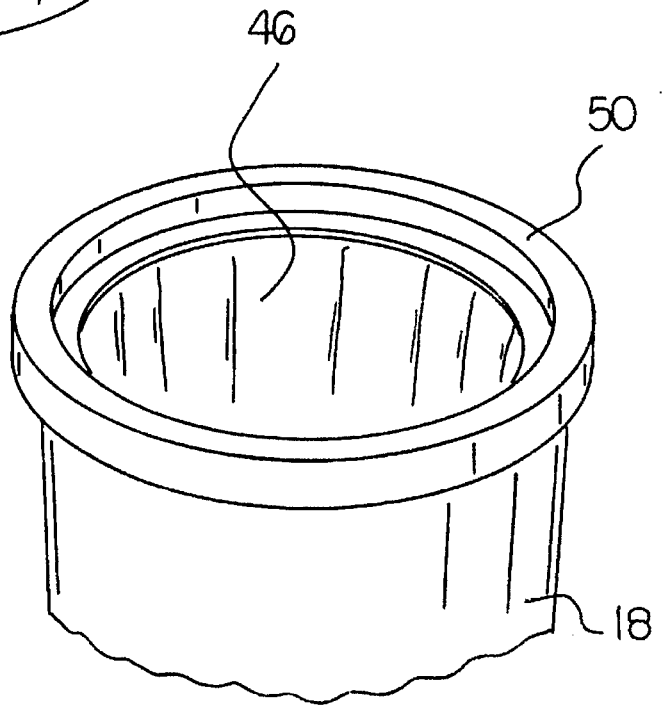
FIG. 2 is a plan perspective view of an upper section of the present invention.
Figure 3:
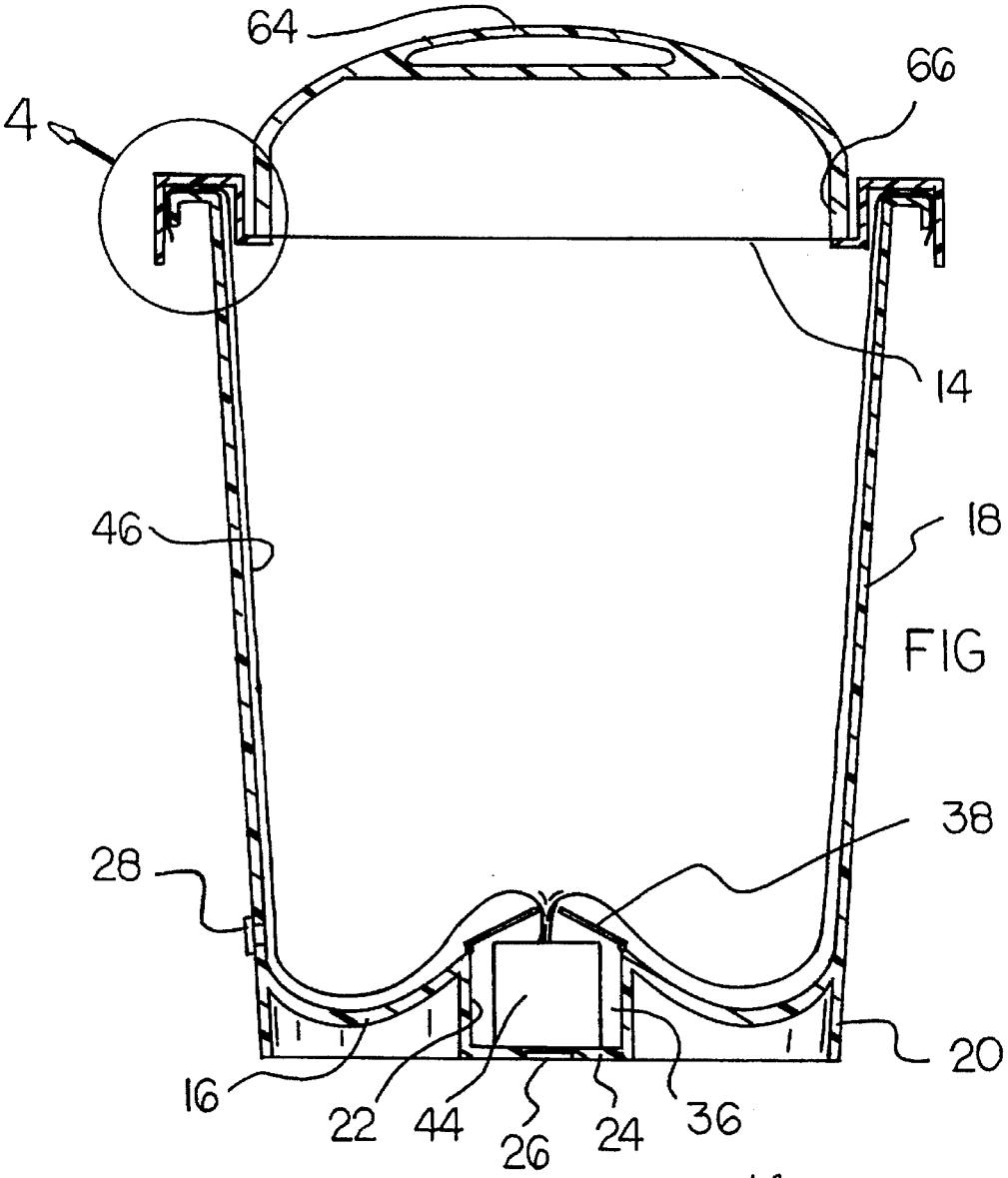
FIG. 3 is a cross-sectional view as taken along line 3—3 of FIG. 1.
Figure 4:
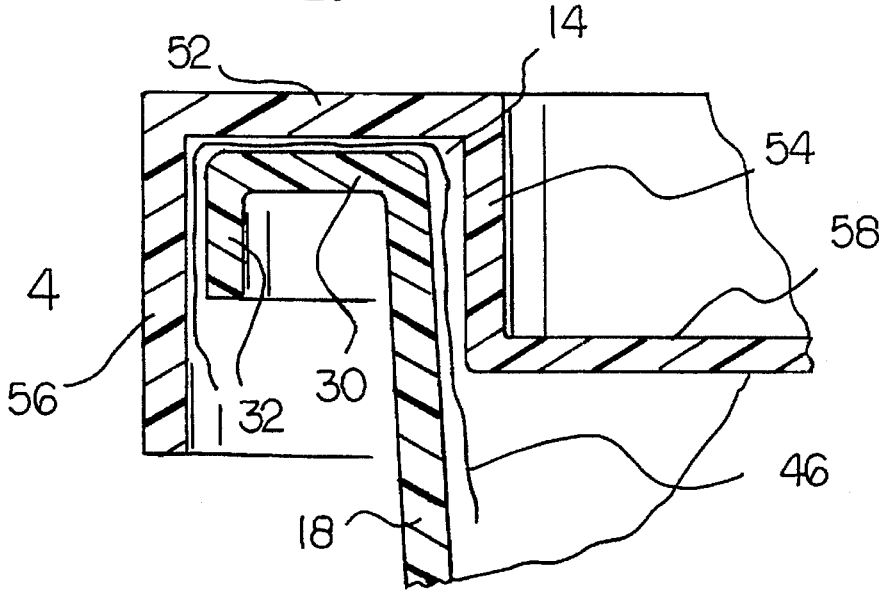
FIG. 4 is a fragmentary view as taken along circle 4 of FIG. 3.
Figure 5:
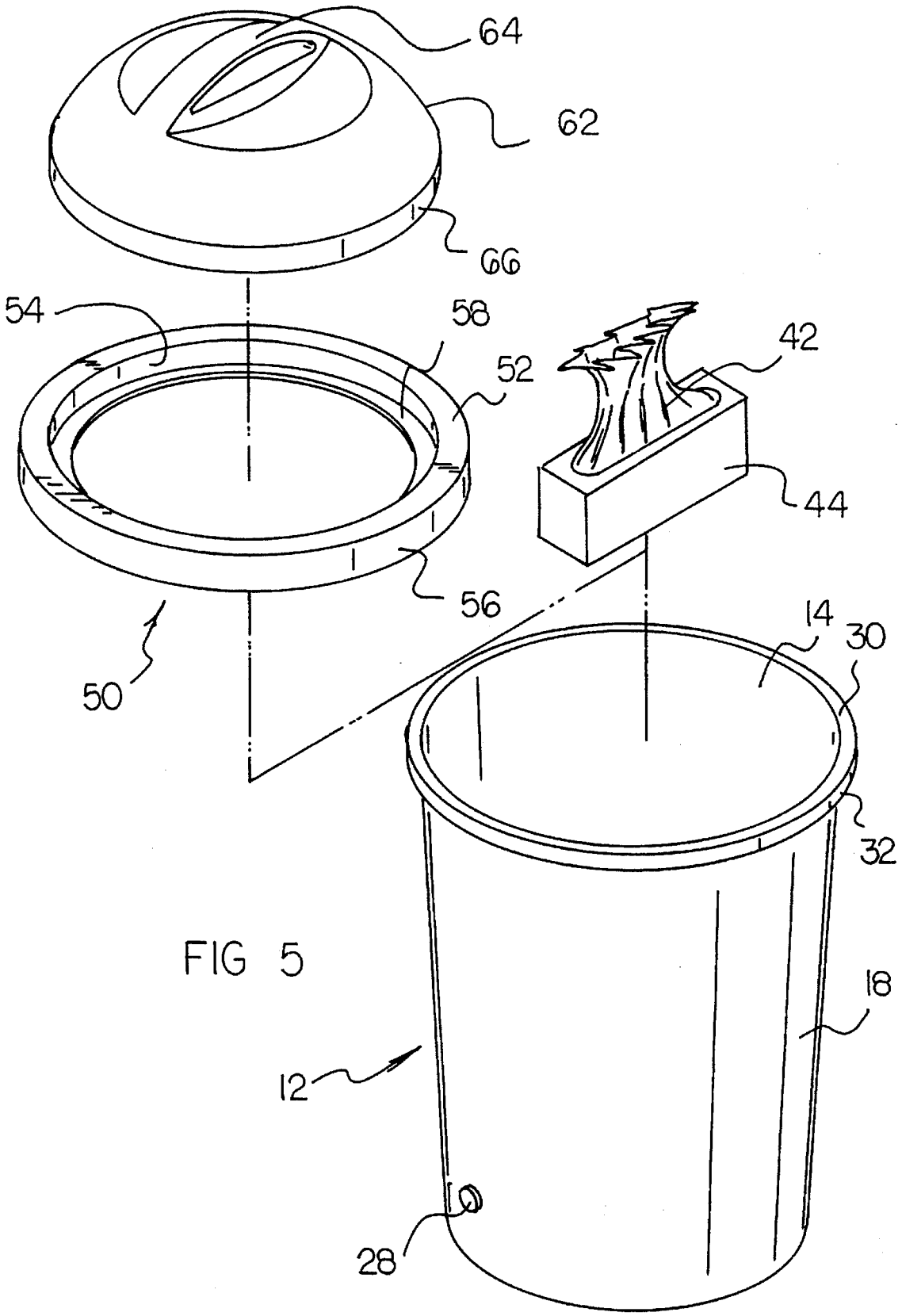
FIG. 5 is an exploded perspective view of the present invention.

With reference now to the drawings, and in particular, to FIGS. 1–5 thereof, the preferred embodiment of the new and improved garbage container and liner dispensing system embodying the principles and concepts of the present invention and generally designated by the reference number 10 will be described.

Specifically, it will be noted in the various Figures that the device relates to a garbage container and liner dispensing system for dispensing a continuing supply of garbage liners within a container. In its broadest context, the device consists of a cylindrical container, an internal bag storage compartment, a plurality of separable trash liners, a bag holding flange and a lid. Such components are individually configured and correlated with respect to each other so as to attain the desired objective.

The system 10 includes a cylindrical container 12 having an open upper end 14, a closed lower end 16 and a cylindrical side wall 18 therebetween. The cylindrical side wall 18 has a lower peripheral edge 20 extending below the closed lower end 16. The closed lower end 16 has an undulating surface. The closed lower end 16 has a recess 22 formed in a central portion thereof. A bottom wall 24 of the recess 22 has a drainage aperture 26 therethrough. A stopper is removably coupled with the drainage aperture 26 to prevent unwanted leakage therethrough. The cylindrical side wall 18 has a drainage aperture 28 therethrough upwardly of the closed lower end 16. A stopper is removable coupled with the drainage aperture 28 to prevent unwanted leakage. The open upper end 14 has a peripheral rim 30 extending horizontally therefrom. The peripheral rim 30 has a downturned outer portion 32. The size and dimensions of the cylindrical container 12 can be varied to accommodate a variety of applications.

An internal bag storage compartment 36 is formed within the recess 22 in the closed lower end 16 of the cylindrical container 12 by a pair of spring-hinged lids 38 secured to an upper end of the recess 22. The spring-hinged lids 38 are biased inwardly towards the recess 22 whereby the lids 38 can cover the upper end of the recess 22.

A plurality of separable trash liners 42 are secured within a dispensing box 44. The dispensing box 44 is dimensioned for positioning within the internal bag storage compartment 36. A singular liner 46 is extendable outwardly of the storage compartment 36 and overlapping the peripheral rim 30 of the cylindrical container 12. The trash liners 42 are separated from one another by a perforated line which allows individual liners 42 to removed from the dispensing box 44. The liner 46 is extended up and over the peripheral rim 30 to be filled by trash. Once the liner 46 has been filled or is required to be removed, a person simply pulls upwardly on the liner 46 until the perforated line appears. The person tears the filled liner from an unused liner. The unused or new liner is then positioned on the peripheral rim 30 for use. The filled liner can then be disposed.

The system 10 also includes a bag holding flange 50 comprised of an annular ring 52 having an interior downturned annular portion 54 and an exterior downturned annular portion 56. The interior downturned annular portion 54 has an inwardly extending annular portion 58 integral with a lower end thereof. The annular ring 52 is positioned on the peripheral rim 30 of the cylindrical container 12 thereby covering the overlapping liner 46. The bag holding flange 50 can be removed from the peripheral rim 30 to allow for the removal of the liner 46. The bag holding flange 50 is used to cover the unsightly appearance of the liner 46 thereby providing a neater appearance.

Lastly, the system 10 includes a lid 62 having an annular configuration. The lid 62 has a formed handle 64 on an upper portion thereof. The lid 62 has a lower annular portion 66 dimensioned for removable positioning on the inwardly extending annular portion 58 of the bag holding flange 50.

The present invention is a specially designed waste container that features a neat holding system to secure liner bags in position, and a convenient internal storage compartment to hold and dispense a continuing supply of plastic liner bags.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A garbage container and liner dispensing system for dispensing a continuing supply of garbage liners within a container comprising, in combination:

a cylindrical container having an open upper end, a closed lower end and a cylindrical side wall therebetween, the cylindrical side wall having a lower peripheral edge extending below the closed lower end, the closed lower end having a recess formed therein, a bottom wall of the recess having a drainage aperture therethrough, the cylindrical side wall having a drainage aperture therethrough upwardly of the closed lower end, the open upper end having a peripheral rim extending horizontally therefrom, the peripheral rim having a downturned outer portion;

an internal bag storage compartment formed within the recess in the closed lower end of the cylindrical container by a pair of spring-hinged lids secured to an upper end of the recess;

a plurality of separable trash liners secured within a dispensing box, the dispensing box dimensioned for positioning within the internal bag storage compartment, a singular liner extendable outwardly of the storage compartment and overlapping the peripheral rim of the cylindrical container;

a bag holding flange comprised of an annular ring having an interior downturned annular portion and an exterior downturned annular portion, the interior downturned annular portion having an inwardly extending annular portion integral with a lower end thereof, the annular ring positioned on the peripheral rim of the cylindrical container thereby covering the overlapping liner; and a lid having an annular configuration, the lid having a formed handle on an upper portion thereof, the lid having a lower annular portion dimensioned for removable positioning on the inwardly extending annular portion of the bag holding flange.

2. A garbage container and liner dispensing system comprising:

a cylindrical container having a recess formed in a lower end thereof;

an internal bag storage compartment formed within the recess in the lower end of the cylindrical container by a pair of spring-hinged lids secured to an upper end of the recess;

a bag holding flange positioned on a peripheral rim of the cylindrical container; and a lid dimensioned for removable positioning on the bag holding flange.

3. The system as set forth in claim 2 wherein a bottom wall of the recess of the cylindrical container having a drainage aperture therethrough, a cylindrical side wall of the cylindrical container having a drainage aperture therethrough upwardly of the lower end thereof.

4. The system as set forth in claim 2 wherein an open upper end of the cylindrical container having the peripheral rim extending horizontally therefrom, the peripheral rim having a downturned outer portion.

5. The system as set forth in claim 2 and further including a plurality of separable trash liners secured within a dispensing box, the dispensing box dimensioned for positioning within the internal bag storage compartment, a singular liner extendable outwardly of the storage compartment and overlapping the peripheral rim of the cylindrical container.

6. The system as set forth in claim 2 wherein the bag holding flange comprised of an annular ring having an interior downturned annular portion and an exterior downturned annular portion, the interior downturned annular portion having an inwardly extending annular portion integral with a lower end thereof, the annular ring positioned on the peripheral rim of the cylindrical container thereby covering a liner extending thereover.

7. The system as set forth in claim 6 wherein the lid having an annular configuration, the lid having a formed handle on an upper portion thereof, the lid having a lower annular portion dimensioned for removable positioning on the inwardly extending annular portion of the bag holding flange.

* * * * *